US005095731A

United States Patent [19]

Greslin

[11] Patent Number: 5,095,731

[45] Date of Patent: Mar. 17, 1992

[54] SHELL CASING MACHINE

[75] Inventor: Bernard Greslin, Parkland, Fla.

[73] Assignee: General Ordnance Corporation, Fort Lauderdale, Fla.

[21] Appl. No.: 701,804

[22] Filed: May 17, 1991

[51] Int. Cl.[5] ..... B21J 13/08

[52] U.S. Cl. ..... 72/361; 72/356; 29/1.3

[58] Field of Search ..... 72/361, 352, 356, 349; 29/1.3, 1.31, 1.32

[56] References Cited

U.S. PATENT DOCUMENTS

| | | | |
|---|---|---|---|
| 2,332,704 | 10/1943 | Enes et al. | 72/361 |
| 2,341,667 | 2/1944 | Stacy | 72/361 |
| 2,343,006 | 2/1944 | Gibbs | 72/361 |
| 2,374,596 | 4/1945 | Frederick | 72/361 |
| 2,786,217 | 3/1957 | Johnson | 29/1.3 |
| 3,061,908 | 11/1962 | Duffield | 29/1.3 |
| 3,478,563 | 11/1969 | Bozek | 72/361 |
| 4,455,725 | 6/1984 | Van Baal | 29/1.3 |

FOREIGN PATENT DOCUMENTS

| | | | |
|---|---|---|---|
| 601775 | 7/1960 | Canada | 29/1.3 |
| 1212677 | 2/1986 | U.S.S.R. | 72/361 |

*Primary Examiner*—David Jones
*Attorney, Agent, or Firm*—Joseph Zallen

[57] ABSTRACT

A system for cold-forming shell or cartridge casings in which there are movable tubular dies having open ends and adapted to accommodate a casing, and which includes a feeding station having an upper punch for inserting a casing into a die; a header-forming station including an upper high force punch, a lower punch, and an ejector; an ejection station including a punch for ejecting a casing from the die; and a turntable for sequentially moving a die to the loading station, forming station and ejection station.

3 Claims, 3 Drawing Sheets

SHELL CASING MACHINE

BACKGROUND OF INVENTION

This invention relates to a improved system for cold forming brass shell or cartridge casings. In particular it relates to such a system which provides greater accuracy, faster production, and a simpler and less expensive mechanism. Examples of the prior art may be found in U.S. Class 29, Sub-Classes 1.30, 1.31, 1.32, and Class 72, Sub-Classes 348, 356, and 361. Examples of such prior art are the following U.S. Pat. Nos.: 437,442, 1,363,597, 2,003,438, 3,026,598, 3,408,718, 3,498,221, 3,614,816, 4,198,843.

Since the beginning of metal-cased ammunition, the shape and dimensions of the cartridge case head have been obtained through a cold forming operation called "heading". This cold forming operation typically uses a die in which the casing is placed, an inside punch and an outside punch. Present day heading machines are arranged so that the inside punch feeds the cartridge case into the die, holds the die against the outside punch during the heading operation, ejects the case after the operation is completed, and is then retracted. The outside punch performs the formation of the heading in conjunction with the outside punch but must also be retracted back from the die to allow the ejection of the casing with the newly formed heading.

A typical current machine includes a hopper from which a cartridge case is positioned between the die and an inside punch. A cam-operated slide which holds the inside punch pushes the case into the die and then stops. A locking device protects the cam-operated mechanism against the very substantial heading force provided by the outside punch. A typical small caliber cartridge case needs a heading force of about 20 tons or 200 kilonewtons. A toggle press holds the outside punch and provides the necessary force for the heading operation. The cam-operated slide holding the inside punch then moves further to push the headed case out of the die for ejection. Then the inside punch is retracted. There are several disadvantages to this type of operation. One is that two synchronized mechanisms are required to operate the two punches. Also, the length of the inside punch is so great as to make it too flexible to achieve the required accuracy. In addition, long strokes slow down the production rate. Further, present day heading machines are typically custom designed and use little commercially available sub-assemblies.

SUMMARY OF INVENTION

The new system of the present invention utilizes a plurality of stations each having a different function, with the product being moved from one station to another. At the first station there is a punch and open tubular die. A shell casing is fed to the first station where the punch pushes the casing into the die. The die, with the shell casing pushed in it, is now moved to a second station. At the second station a very powerful forming punch in conjunction with a fixed outside forming punch enters the casing and forms the heading. The forming punch is then withdrawn, and the die holding the casing is now moved to a third station. At the third station an elongated third punch pushes the finished work- piece out of the die.

A typical assembly has a circular plate holding a plurality of dies which are periodically moved into position so that each of the stations can be operating at the same time on a different shell casing.

SPECIFIC EXAMPLE OF INVENTION

Figure 1:
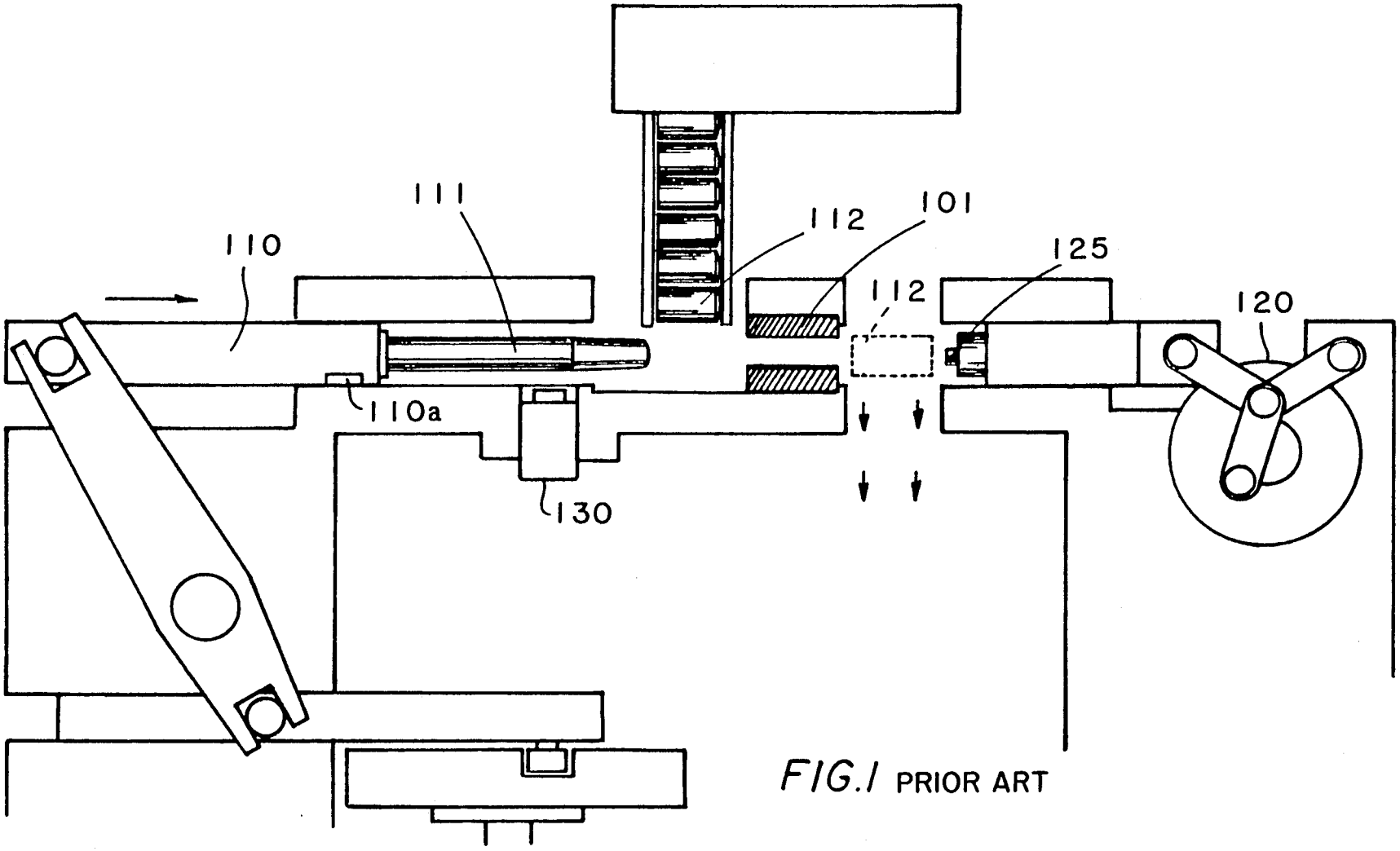
FIG. 1 PRIOR ART
FIG. 1 is a diagrammatic view of a typical prior art device.
Figures 2, 3, 4:
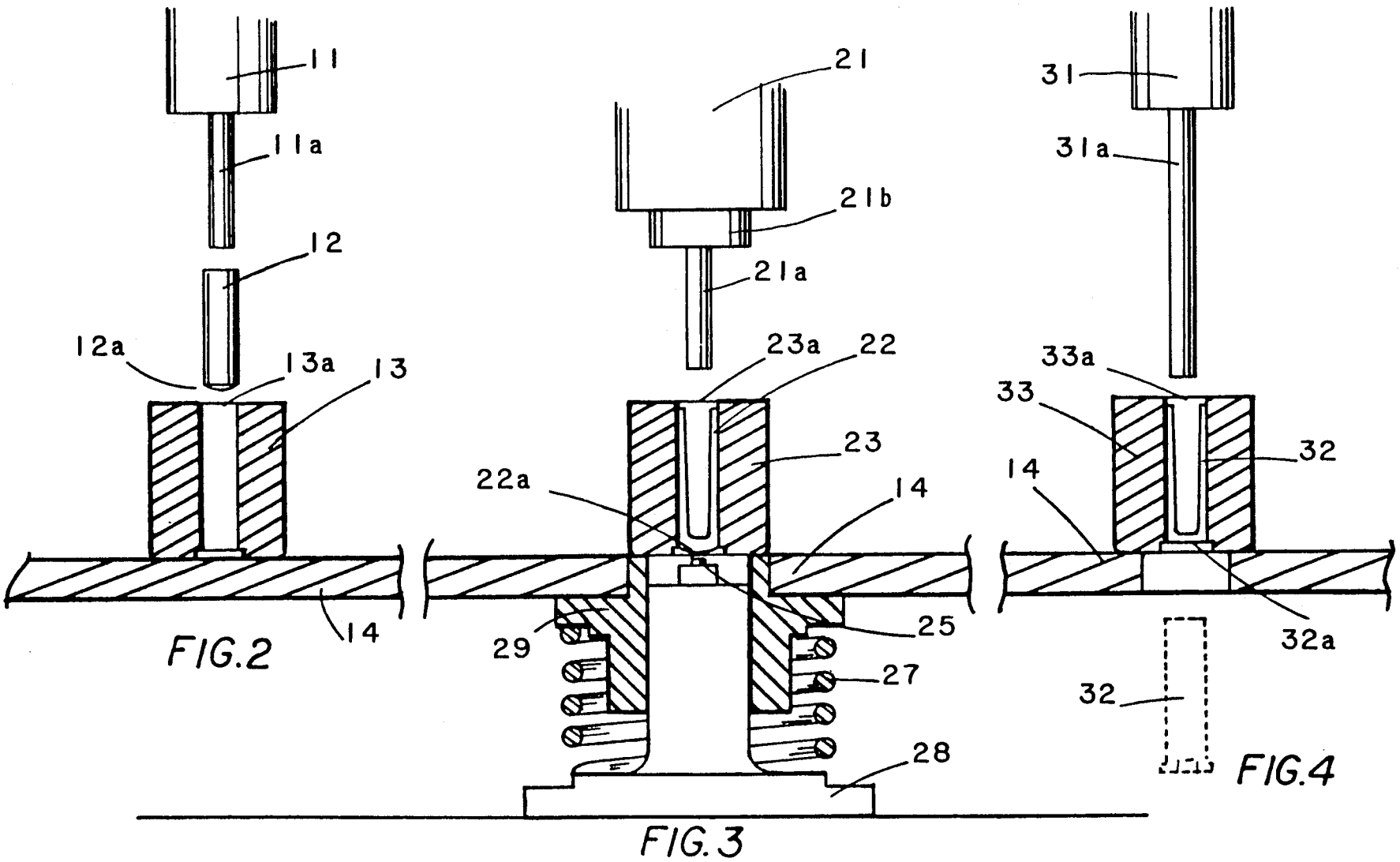
FIG. 2 is a side diagrammatic view with partial section of the feeding station of an example of the present invention.
FIG. 3 is a side diagrammatic view with partial section of the heading-forming station to which a die is moved after the feeding station.
FIG. 4 is a side diagrammatic view with partial section of the ejection station after the die has been moved to it after the head-forming station.
Figure 5:
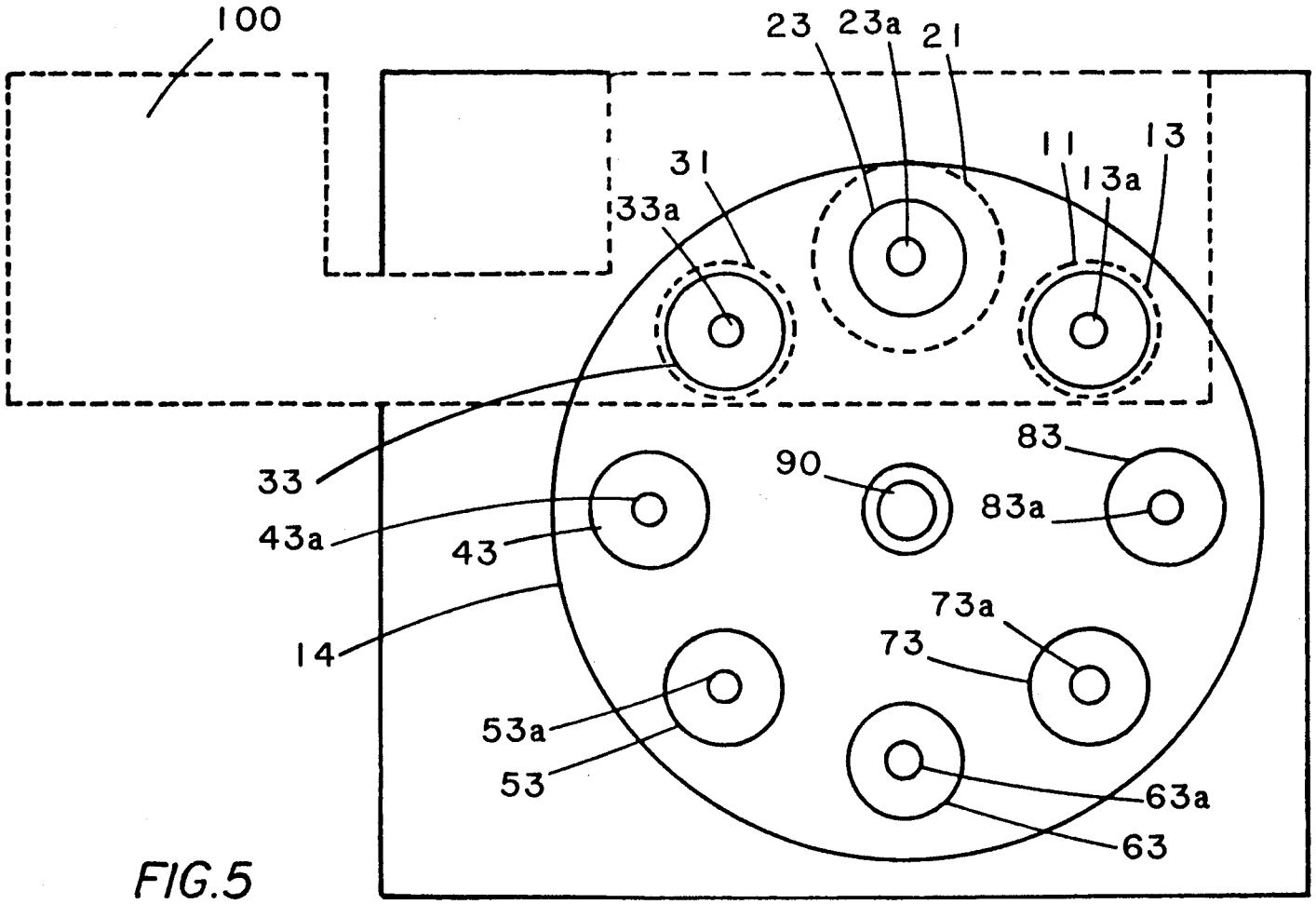
FIG. 5 is a top diagrammatic view showing the revolving support platform for the dies and the position of the stations.

As shown in the diagrammatic view of FIG. 1, a typical example of the prior art has a cam- operated slide 110 which is the driver for inside punch 111. The punch 111 engages the shell casing 112 and pushes it into the die 101. The locking device 130 engages the recess 110*a* of cam operable slide 110. Mechanism 120 pushes outside punch 125 against the casing 112 held in the die 101 by punch 111. After the cartridge heading is formed in shell casing 112, locking device 130 is disengaged. Outside punch 125 is withdrawn and punch 111 pushes the casing 112 out of the die 101 so that it is ejected. Then the inside punch 111 is withdrawn to its initial position to take on the next shell casing.

In the example of the present invention illustrated in FIGS. 2, 3, 4 and 5 there are three stations, a feeding station having upper punch 11, a forming station having upper punch 21, and an ejection station having upper punch 31. The three stations have fixed positions and register consecutively with dies 13, 23, and 33 which are moved in a circular pattern on base plate 14.

At the feeding station punch end 11*a* is inserted into shell casing 12 which is a rounded header 12*a* and pushes the casing 12 into tubular die 13.

At the same time, at the forming station, shell casing 22 has been previously positioned in tubular die 23 with its curved header 22*a*. Above the die is a high force upper punch holder 21 whose lower part 21*b* pushes down tubular die 23 while punch 21*a* enters casing 22. Upper punch 21, together with tubular die 23 and casing 22, pushes down ejector 29, compressing coil spring 27, and press header 22*a* against fixed lower punch 25 which is directly bolted to the frame of the machine. After forming, upper punch 21 withdraws to its upper position allowing spring loaded ejector 29 to push tubular die 23 containing formed casing 22 back to transfer level.

At the same time, at the ejection station, casing 32 having header 32*a* previously formed at the forming station is ejected by a relatively low pressure upper punch 31 with a punch end 31*a*.

After the punches are withdrawn, circular table 14 is arranged to revolve on its shaft 90 to move counter clockwise one-eighth of a turn so that each of the dies is moved to the next station or out of the station area. In the diagrammatic model of FIG. 5 there are a total of eight dies, 13, 23, 33, 43, 53, 63, 73 and 83, which are supported on platform 14. Each of these dies is tubular with an opening 13*a*, 23*a*, 33*a*, 43*a*, 53*a*, 63*a*, 73*a*, or 83*a*.

In the support area below each die is an opening which permits the engagement at the forming station and the expulsion at the ejection station.

I claim:

1. A system for cold-forming shell or cartridge casings comprising in combination:

a) a plurality of movable tubular dies having open ends and adapted to accommodate a casing;

b) a feeding station having an upper punch for inserting a casing into a said die;

c) a header-forming station including a movable upper high force punch, a fixed lower punch, and resilient ejector means cooperable with said upper punch, whereby said die and casing are pushed down against said lower punch, and after the heading is formed said die and casing are pushed back to the transfer level when said upper punch is withdrawn;

d) an ejection station including a punch for ejecting a casing from a said die; and e) means for sequentially moving a said die to said loading station, said header-forming station and said ejection station.

2. The casings-forming system of claim 1 wherein each of said stations can operate on a different casing at the same time.

3. The casings-forming system of claim 1 wherein said means for moving a said die comprises a turntable.

* * * * *